United States Patent [19]

Yan

[11] 3,989,617

[45] Nov. 2, 1976

[54] CATALYTIC TREATMENT OF LUBRICATION OIL BASE STOCK FOR IMPROVEMENT OF OXIDATIVE STABILITY

[75] Inventor: Tsoung-Yuan Yan, Trenton, N.J.

[73] Assignee: Mobil Oil Corporation, New York, N.Y.

[22] Filed: Nov. 22, 1974

[21] Appl. No.: 526,433

Related U.S. Application Data

[63] Continuation-in-part of Ser. No. 390,285, Aug. 21, 1973, abandoned.

[52] U.S. Cl. ..... 208/87; 208/18; 208/111; 208/120

[51] Int. Cl.[2] ..... C10G 37/04

[58] Field of Search ..... 208/120, 264, 307, 87, 208/18

[56] References Cited

UNITED STATES PATENTS

| | | | |
|---|---|---|---|
| 2,967,144 | 1/1961 | Cole | 208/87 |
| 3,549,520 | 12/1970 | Morris | 208/264 |
| 3,700,585 | 10/1972 | Chen et al. | 208/111 |
| 3,755,138 | 8/1973 | Chen et al. | 208/33 |
| 3,755,145 | 8/1973 | Orkin | 208/18 |
| 3,853,749 | 12/1974 | Espenscheid et al. | 208/264 |

*Primary Examiner*—Herbert Levine
*Attorney, Agent, or Firm*—Charles A. Huggett; Vincent J. Frilette

[57] ABSTRACT

This invention relates to a method of catalytically treating lubricating oil base stocks with certain crystalline zeolite catalysts, exemplified by ZSM-5 zeolite, in order to improve the oxidative stability of the base stocks. The treatment is conducted under very mild conditions with minimal loss of lubricant material.

7 Claims, No Drawings

CATALYTIC TREATMENT OF LUBRICATION OIL BASE STOCK FOR IMPROVEMENT OF OXIDATIVE STABILITY

CROSS-REFERENCE TO RELATED APPLICATIONS

This application is a continuation-in-part of U.S. Pat. application Ser. No. 390,285, filed Aug. 21, 1973 now abandoned.

BACKGROUND OF THE INVENTION

1. Field of the Invention

This invention concerns the production of lubricating oils and greases which have superior oxidative stability.

2. Description of the Prior Art

It is known that lubricating oils tend to deteriorate after being in use for some period of time. Exposure to air, contamination by water, and contact with metal surfaces in their functional environments contribute to this deterioration. Oxidation by air is probably a most important factor contributing to degradation. As an example, in modern internal combustion engines and in turbojet engines, hot lubricants of inadequate oxidation resistance can be attacked by oxygen or air to form heavy viscous sludges, varnish and resins which become deposited on the engine surfaces. Corrosive acids also can form in this process. As a result, the lubricant cannot perform its required task effectively, and the engine does not operate efficiently. Furthermore, the sludges produced tend to foul and plug low tolerance hydraulic system components and interconnecting piping and valves.

When lubricating oils of inadequate oxidation stability are formulated into greases, similar results are encountered, thus clearly indicating the necessity for improved methods of treatment which increase the oxidative stability of lubricating oils.

Accompanying the deterioration of lubricants by oxidation is the resultant corrosion of the metal surfaces for which such lubricants are designed and supplied. Once a lubricant has been oxidized to produce viscous sludges and resins, acids develop which are corrosive enough to attack most metals and result in excessive metal wear. Because of the adverse effects of using deteriorated lubricants, the user is constrained to replace the lubricants at more or less frequent intervals.

Newer and larger engines are being made that operate under conditions that create a more severe environment for the lubricants. Petroleum crude oils which were previously suitable for lubricant production are presently unsuitable or at best marginal for such use. Thus at a time when overall lubricant demands are increasing, the amount of suitable lubricant feedstock material is being diminished due to the oxidative stability requirements of newer and larger machinery.

Lubricant base stocks are usually prepared by refining fractions of the atmospheric residium of suitable petroleum crudes. Refining consists of one or more subtractive operations, such as solvent extractions, to remove undesirable constituents such as waxes, resins, and low viscosity index compounds. These subtractive operations characteristically result in very substantial but necessary volume losses. Deep furfural extraction with concomitant high loss, for example, may be needed not only to arrive at a high viscosity index base stock but also to impart the required oxidation stability.

Removal of waxes to reduce pour point may be conducted with solvent, or catalytically with a ZSM-5 type catalyst as described in U.S. Pat. No. 3,700,585; or by the sequential use of solvent and catalyst as described in U.S. Pat. No. 3,755,138.

Various antioxidant additives, such as described for example in U.S. Pat. No. 3,399,041 (McCabe), have been developed to improve the oxidative stability of lubricant base stocks. However, such additives are expensive to produce and may present metering and mixing problems when added to lubricants.

Accordingly, it is an object of this invention to provide a method whereby the oxidative stability of lubricant base stocks is improved.

A further object of this invention is to provide a high-yield method of treatment whereby hydrocarbon base stocks of poor or marginal quality may be upgraded in oxidative stability.

Another object of this invention is to provide a method of lubricant treatment whereby the lubricant produced has sufficient oxidative stability to substantially reduce metals corrosion and wear when employed as a lubricant for such metals.

Another object of this invention is to provide a method of upgrading lubricant base stocks to a quality adequate for use in severe service environments.

Other objects and advantages of this invention will become apparent to those skilled in the art upon reading the entire specification including the following detailed description and claims.

SUMMARY OF THE INVENTION

It has now been found that the oxidative stability of a lubricant base stock may be increased by contacting the base stock with a certain type of zeolite catalyst under very mild conditions as described below. With proper selection of the treatment conditions, a marked increase in stability is achieved with recovery of at least 90 percent of the base stock. Recovery may be up to almost 100 percent, for example 99 percent.

DETAILED DESCRIPTIONS

The lubricating oil base stocks, or lubricant base stocks, referred to herein are to be understood to refer to refined hydrocarbon oils such as a lubricant manufacturer would use in formulating a finished lubricant. The refined oils are prepared from lubricant raw materials which are the raw oil fractions produced by the vacuum fractionation of suitable "reduced crudes". The reduced crudes in turn are in the residua obtained by atmospheric tower distillation of whole crudes. The base stocks might be formulated by blending with one another to a desired viscosity, or formulated with antiwear, antioxidant or other additives. The lubricant base stocks suitable for treatment by the method of this invention may be further characterized as refined oils that have been prepared by at least one stage of solvent-refining to significantly reduce the content of such undesirable constituents as asphaltic bodies, resins, low viscosity index constituents and waxes as may be present in the raw oil fractions. Such lubricant base stocks either have inherently low wax content or have been dewaxed so that the pour point is less than about 30° F. The lubricant base stock to be treated by the method of this invention has a viscosity of about 50 to 1000 S.U.S. at 100° F (i.e. Saybolt Universal Seconds, measured at 100° F) and between 100 and 400 S.U.S. at 100° F in a preferred embodiment.

A lubricating oil base stock is improved in oxidation stability, i.e. upgraded, as will hereinafter be demonstrated, by contacting it with a certain type of crystalline aluminosilicate zeolite catalyst at a temperature of from about 325° F to about 700° F, and preferably from about 450° F to about 625° F. Contacting the oil with the catalyst may be done in batch fashion, but it is preferably done in a flow system at a space velocity of from about 0.1 to about 10 LHSV (i.e. about 0.1 volume of oil to 10 volumes of oil per volume of catalyst per hour). It is preferred to avoid contact with air during the catalytic treatment. This can be accomplished by feeding a small volume of nitrogen or hydrogen through the reactor along with the base stock, and conducting the treatment at a pressure of from 0 psig to about 250 psig. The use of hydrogen as a blanket or as a gaseous co-feed is advantageous in providing a lighter-colored product. A suitable method of contacting the lubricating oil base stock with the catalyst is to flow it upwards through a fixed bed of catalyst under the above prescribed conditions.

The catalysts useful in this invention are the members of a recently discovered novel class of zeolites that has unusual properties. Although they have unusually low alumina contents, i.e. high silica to alumina ratios, they are very active in causing organic molecules to react even when the silica to alumina ratio exceeds 30. The activity is surprising since the alumina in the zeolite framework is believed responsible for catalytic activity. These catalysts retain their crystallinity for long periods even in the presence of steam at high temperature which induces irreversible collapse of the framework of other zeolites, e.g. of the X and A type. Furthermore, carbonaceous deposits, when formed, may be removed by burning at higher than usual temperatures to restore activity.

An important characteristic of the crystal structure of this class of zeolites is that it provides constrained access to, and egress from, the intracrystalline pores by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type catalyst useful in this invention posess, in combination: a silica to alumina ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic form within the channels. Although catalysts with a silica to alumina ratio of at least 12 are useful, it is preferred to use catalysts having higher ratios of at least about 30. Such catalysts, after activation, acquire an intracrystalline sorption capacity for normal hexane which is greater than that for water, i.e. they exhibit "hydrophobic" properties.

The type zeolites useful in this invention freely sorb normal hexane and have a pore dimension greater than about 5 Angstroms. In addition, the structure must provide constrained access to larger molecules such as are present in lube oil base stocks. It is sometimes possible to judge from a known crystal structure whether such constrained access exists. For example, if the only pore windows in a crystal are formed by eight numbered rings of oxygen atoms, then access to molecules of larger cross-section than normal hexane is excluded and the zeolite is not of the desired type. Windows of ten-membered rings are preferred, although excessive puckering or pore blockage may render these catalysts ineffective. Twelve-membered rings do not generally appear to offer sufficient constraint to produce the subtle changes leading to enhanced oxidation stability although structures can be conceived, due to pore blockage or other cause, that may be operative.

Rather than attempt to judge from crystal structure whether or not a catalyst posesses the necessary constrained access, a simple determination of the "constraint index" be made by passing continuously a mixture of equal weight of normal hexane and 3-methylpentane over a small sample, approximately 1 gram or less, of catalyst at atmospheric pressure according to the following procedure. A sample of the catalyst, in the form of pellets or extrudate, is crushed to a particle size about that of coarse sand and mounted in a glass tube. Prior to testing, the catalyst is treated with a stream of air at 100° F for at least 15 minutes. The catalyst is then flushed with helium and the temperature adjusted between 550° F and 950° F to give an overall conversion between 10% and 60%. The mixture of hydrocarbons is passed at 1 liquid hourly space velocity (i.e. 1 volume of hydrocarbon per volume of catalyst per hour) over the catalyst with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The constraint index is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those having a constraint index from 1.0 to 12.0, preferably 2.0 to 7.0.

The class of zeolites defined herein is exemplified by ZSM-5, ZSM-11, ZSM-12, ZSM-21, TEA mordenite and other similar materials. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-21 is more particularly described in U.S. application, Ser. No. 358,192, filed May 7, 1973, now abandoned, the entire contents of which are incorporated herein by reference.

TEA mordenite is more particularly described in U.S. application Ser. No. 130,442, filed Apr. 11, 1971, now abandoned, the entire contents of which are incorporated herein by reference.

The specific zeolites described, when prepared in the presence of organic cations, are catalytically inactive, possible because the intracrystalline free space is occupied by organic cations from the forming solution. They may be activated by heating in an inert atmosphere at 1000° F for one hour, for example, followed by base exchange with ammonium salts followed by calcination at 1000° F in air. The presence of organic cations in the forming solution may not be absolutely essential to the formation of this type zeolite; however, the presence of these cations does not appear to favor the formation of this special type of zeolite. More generally, it is desirable to activate this type catalyst by base exchange with ammonium salts followed by calcination in air at about 1000° F for from about 15 minutes to about 24 hours.

Natural zeolites may sometimes be converted to this type zeolite catalysts by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-21, and TEA mordenite, with ZSM-5 particularly preferred.

The catalysts of this invention may be in the hydrogen form which is the preferred form, or they may be base exchanged or impregnated to contain ammonium or a metal cation complement. It is desirable to calcine the catalyst after base exchange. The metal cations that may be present include any of the metals of Groups I through VII of the periodic table that do not contribute a hydrogenation-dehydrogenation function to the catalyst. However, in the case of Group IA metals, the cation content should in no case be so large as to effectively inactivate the catalyst. For example, a completely sodium exchanged H-ZSM-5 is not operative in the present invention.

In a preferred aspect of this invention, the catalysts hereof are selected as those having a crystal density, in the dry hydrogen form, of not substantially below about 1.6 grams per cubic centimeter. The preferred catalysts of this invention are those that satisfy three criteria, i.e. having a constraint index as defined above of about 1 to 12, a silica to alimina ratio of at least about 12 and a dried crystal density in the hydrogen form of not less than about 1.6 grams per cubic centimeter. The dry density for known structures may be calculated from the number of silicon plus aluminum atoms per 1000 cubic Angstroms, as given, e.g. on page 11 of the article on Zeolite Structure by W. M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, is important as the locus of selective catalytic activity.

The zeolite catalyst can be used as such or in a matrix form, that is incorporated in a matrix, suitably of alumina.

It is essential for the present invention that mild conversion conditions be used in contacting the lubricant base stock with the catalyst. While different lubricant base stocks may require somewhat different conditions of temperature and space velocity to produce an upgraded base stock of adequate oxidation resistance, the combinations of temperature and contact time used to be selected so as to recover upgraded base stock in an amount of at least 90 percent by weight of the lubricant base stock charged, and preferably at least 93 percent. Recoveries generally will be higher, and may be as high as about 99 percent. Thus, it is a feature of this invention that the improvement in oxidation resistance is achieved at a very small penalty in recovery. The minor losses that occur are due to catalytic conversion of the charged molecules to fragments that volatilize when the treated product is heated to 650° F. The term "recovery", as above specified, is meant to refer to product free of such volatile fragments. Phrased in another way, in the practice of this invention the lubricant base stock is contacted with the described catalyst at a temperature of from about 325° F to about 700° F and at a space velocity within the range of from about 0.1 LHSV to about 10 LHSV to convert not more than about 10 percent, and preferably not more than about 7 percent, of the lubricant base stock to fragments volatile at 650° F.

Under the mild treatment conditions above as described, it is believed that no significant change of properties occurs other than enhanced oxidation stability. The pour point of the upgraded base stock, for example, may remain unchanged or it may be lowered slightly, but in any case the treatment with the zeolite should be mild enough so as to reduce the pour point by not more than 15° F.

It may be desirable for some applications to remove the volatile fragments from the treated lubricant base stock prior to its utilization in a lubricant. This removal, or "stabilization", is most conveniently done by blowing the hot effluent from the contacting step with nitrogen or hydrogen, with or without further increase in temperature to 650° F, as desired, for a period of time from about 5 minutes to about one hour. Alternatively, other means for stabilization may be used, such as flowing the oil at 650° F through an adequately vented vessel. Other means for stabilizing the upgraded base stock will occur to those skilled in the art.

It is not understood precisely why the process of this invention so markedly improves the oxidation stability of lubricant base stocks. Chemical reactions in the presence of oxygen usually are very complex, and especially so with mineral oils which themselves are complicated mixtures of many hydrocarbons. It is surprising that the mild treatment conditions employed in this invention so selectively alters the complex chemical mixture of the base stock to produce enhanced stability.

DESCRIPTION OF SPECIFIC EMBODIMENTS

Examples 1–9

A mid-continent lubricant base stock (MSCL) having a viscosity of 200 S.U.S. at 100° F, and a pour point of 0° F, was passed over calcined HZSM-5 catalyst in an upflow reactor at 500°–600° F, 0.5–1.0 LHSV and atmospheric pressure.

As noted in U.S. Pat. No. 3,702,866 previously referred to with respect to a definition of ZSM-5 zeolite, ZSM-5 generally corresponds to the empirical formula expressed in mole ratios of oxides as follows:

$$0.9 \pm 0.2\ M_{2/n}O : W_2O_3 : 5\text{–}100\ YO_2 : z\ H_2O$$

wherein M is at least one cation, $n$ is the valence thereof, W is selected from the group consisting of aluminum and gallium, Y is selected from the group consisting of silicon and germanium, and $z$ is from 0–40, and characterized by a specified X-ray powder diffraction pattern.

HZSM-5 refers to such a ZSM-5 zeolite wherein the cation M constituent (such as Na+ for example) is replaced in whole or in part with a hydrogen ion, or a hydrogen ion precursor (such as tetramethyl ammonium for example) and then calcined.

Following the passing of the MCSL chargestock over the HZSM-5 catalyst as described above, gas produced by the reaction was collected and analyzed for hydrogen ($H_2$). On the average about 0.6 to 1.2% of the hydrocarbon molecules had one molecule of $H_2$ removed. In the runs where hydrogen was used, the reactor pressure was maintained at 50 p.s.i.g. The liquid product was stripped to 650° F to remove all light ends and then analyzed for color and oxidation characteristics.

The oxidative stability was determined in accordance with the following test procedure.

In a 200 mm. by 25 mm. test tube is placed a 25 gram sample of a test oil, having immersed therein: (a) 15.6 sq. in. of sand blasted iron wire; (b) 0.78 sq. in. of polished copper wire: (c) 0.87 sq. in. of polished aluminum wire and (d) 0.167 sq. in. of a polished lead specimen. The oil sample is heated to a temperature of 325° F and maintained at this temperature while dry air is passed therethrough at a rate of 10 liters per hour for a period of 40 hours. The change in neutralization number, and the kinematic viscosity measured at 212° F for the purpose of this test were recorded for each example before and after oxidation. The weight loss of the lead specimen and Bromine No. analysis for each example was also recorded. The operating conditions, product yield and quality for each of the nine examples are shown in Table I.

The improved oxidative stability of the treated hydrocarbon samples of examples 1–9 is illustrated by the small increase in kinematic viscosity and neutralization number.

As noted in Table I there is some olefinic content in the treated oil as illustrated by the Bromine number. In the presence of hydrogen, the treatment of the MCSL stock over HZSM-5 catalyst did not affect the base stock color; the color did darken somewhat in the absence of hydrogen.

The low lead loss of the examples is indicative of a low corrosion rate. The small increase in kinematic viscosity (ΔKV) and neutralization number (ΔNN) illustrate a low rate of production of heavy hydrocarbon materials such as sludges (which raise viscosity) and acids (which require more base solution for neutralization).

TABLE 1

Catalytic Treatment of Base Oil
Base Oil: MCSL 320, 160% Furfural, 195° F
Catalyst: HZSM-5

| Example No. | 1 | 2 | 3 | 4 | 5 | 6 | 7 | 8 | 9 | |
|---|---|---|---|---|---|---|---|---|---|---|
| Operating Conditions: | | | | | | | | | | |
| Hydrogen Flow | | | NO | | | | | YES | | Feed |
| Pressure, p.s.i.g. | 0 | 0 | 0 | 0 | 0 | 50 | 50 | 50 | 50 | |
| Temperature, °F | 500 | 500 | 550 | 600 | 600 | 500 | 500 | 550 | 600 | — |
| LHSV, V/V Hr | 1.0 | 0.5 | 1.0 | 1.0 | 0.5 | 1.0 | 0.5 | 1.0 | 0.5 | — |
| Product Yield, Wt. % | | | | | | | | | | |
| $H_2$ | .003 | .002 | .006 | — | .003 | — | — | — | — | — |
| Gas | 0.1 | 0.1 | 0.1 | 0.2 | 0.2 | — | — | — | — | — |
| Lt. Product | 1.4 | 3.8 | 4.1 | 7.5 | 9.8 | 0.7 | 0.6 | 2.0 | 7.3 | — |
| Lube | 98.5 | 96.1 | 95.8 | 92.3 | 90.0 | 99.2 | 99.4 | 98.0 | 92.7 | — |
| Product Quality-B-10 test | | | | | | | | | | |
| ΔKV, % | 184 | 164 | 215 | 102 | 71 | 163 | 201 | 193 | 182 | 269 |
| ΔNN | 18.2 | 13.6 | 16.3 | 10.6 | 8.4 | 14.9 | 16.6 | 17.1 | 15.2 | 21 |
| Lead Loss (mg.) | 169 | 98 | 156 | 18 | 21 | 108 | 86 | 95 | 104 | 320 |
| Bromine No. | 0.6 | 0.6 | 0.6 | 0.8 | 0.7 | 0.5 | 0.6 | 0.6 | 0.8 | — |

It will be evident to those skilled in the art that the invention described herein may be used not only to upgrade lubricant base stocks that are marginal or inacceptable for a particular service with respect to oxidation resistance, but it may also be used to augment the available quantity of an acceptable base stock by less severe solvent refining coupled with the upgrading process herein described.

Having described the invention, what is claimed is:

1. In the process of producing a lubricant base stock, said process consisting essentially of vacuum fractionating a crude oil residuum to produce a lubricant raw material and solvent refining said raw material to produce a refined oil having a viscosity at 100° F of from about 50 S.U.S. to about 1000 S.U.S. and a pour point less than about 30° F, the improvement whereby is produced an upgraded lubricant base stock of enhanced oxidation stability which comprises: contacting said refined oil with a crystalline aluminosilicate zeolite, said zeolite being in the hydrogen form, at a temperature of from about 325° F to about 700° F and a space velocity of from about 0.1 to about 10 LHSV, said zeolite having a constraint index of about 1 to 12 and a silica to alumina ratio of at least 12; and recovering at least 90 percent by weight of an upgraded lubricant base stock.

2. The process described in claim 1 and in which said zeolite is characterized additionally by a dried crystal density, in the hydrogen form, of not less than 1.6 grams per cubic centimeter.

3. The process described in claim 1 in which said zeolite is H-ZSM-5.

4. The process described in claim 1 in which said zeolite is H-ZSM-11.

5. The process described in claim 1 in which said zeolite is H-ZSM-21.

6. The process described in claim 1 in which said recovery is at least 93 percent by weight.

7. The process described in claim 1 in which said contacting is done in the presence of hydrogen gas.

* * * * *

UNITED STATES PATENT AND TRADEMARK OFFICE

CERTIFICATE OF CORRECTION

PATENT NO. : 3,989,617

DATED : November 2, 1976

INVENTOR(S) : Tsoung-Yuan Yan

It is certified that error appears in the above-identified patent and that said Letters Patent are hereby corrected as shown below:

| | |
|---|---|
| Col. 2, line 50 | "in" inserted after word "are" (does not appear in application) |
| Col. 4, line 4 | "numbered" should be -- membered -- |
| Col. 4, line 18 | After "index" the word -- may -- is omitted. |
| Col. 4, line 27 | "100°F" should be -- 1000°F -- |
| Col. 4, line 39 | "constraint index" does not appear in quotes -- should be "constraint index"-- |
| Col. 6, line 12 | After "used" the word -- are -- is omitted. |

Signed and Sealed this

Twenty-second Day of February 1977

[SEAL]

*Attest:*

RUTH C. MASON
*Attesting Officer*

C. MARSHALL DANN
*Commissioner of Patents and Trademarks*